US006729438B1

(12) United States Patent
Perrett

(10) Patent No.: US 6,729,438 B1
(45) Date of Patent: May 4, 2004

(54) LADDER PADDING DEVICE

(76) Inventor: Jeffrey D. Perrett, 3424 Vicker Way, Dale, CA (US) 93551

( * ) Notice: Subject to any disclaimer, the term of this patent is extended or adjusted under 35 U.S.C. 154(b) by 0 days.

(21) Appl. No.: 10/304,071

(22) Filed: Nov. 27, 2002

(51) Int. Cl.[7] ..... E04G 1/00; A47B 95/00
(52) U.S. Cl. ..... 182/129; 248/345.1
(58) Field of Search ..... 182/129, 121, 182/107, 230, 214; 248/210, 345.1

(56) References Cited

U.S. PATENT DOCUMENTS 2,518,107 A 8/1950 Wilson
3,993,163 A 11/1976 Barrett
5,058,789 A 10/1991 Piper
D372,989 S 8/1996 Gile et al.
5,673,768 A * 10/1997 Schmitt et al. ..... 182/129
5,692,581 A 12/1997 Nelson et al.
6,006,863 A 12/1999 LeGrand et al.
6,415,890 B1 * 7/2002 Tucker et al. ..... 182/129

* cited by examiner

*Primary Examiner*—Hugh B. Thompson, II

(57) ABSTRACT

A ladder padding device for cushioning the rungs of ladders for the users thereof. The ladder padding device includes a piece of material being adapted to be fastened about a rung of a ladder; and also includes fastening members being attached to the piece of material for fastening the piece of material to the rung of the ladder; and further includes a padding being disposed in the piece of material for cushioning the rung of the ladder.

4 Claims, 2 Drawing Sheets

LADDER PADDING DEVICE

BACKGROUND OF THE INVENTION

1. Field of the Invention

The present invention relates to rung pads for ladders and more particularly pertains to a new ladder padding device for cushioning the rungs of ladders for the users thereof.

2. Description of the Prior Art

The use of rung pads for ladders is known in the prior art. More specifically, rung pads for ladders heretofore devised and utilized are known to consist basically of familiar, expected and obvious structural configurations, notwithstanding the myriad of designs encompassed by the crowded prior art which have been developed for the fulfillment of countless objectives and requirements.

The prior art includes inventions having pads attached to the side rails of the ladders and also has pads attached to the ends of the side rails. While these devices fulfill their respective, particular objectives and requirements, the aforementioned prior art do not disclose a new ladder padding device.

SUMMARY OF THE INVENTION

The general purpose of the present invention, which will be described subsequently in greater detail, is to provide a new ladder padding device which has many of the advantages of the rung pads for ladders mentioned heretofore and many novel features that result in a new ladder padding device which is not anticipated, rendered obvious, suggested, or even implied by any of the prior art rung pads for ladders, either alone or in any combination thereof. The present invention includes a piece of material being adapted to be fastened about a rung of a ladder; and also includes fastening members being attached to the piece of material for fastening the piece of material to the rung of the ladder; and further includes a padding being disposed in the piece of material for cushioning the rung of the ladder. None of the prior art describes pieces of material being wrapped about the rungs of the ladders for providing a cushion for users working upon the ladders.

There has thus been outlined, rather broadly, the more important features of the ladder padding device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new ladder padding device which has many of the advantages of the rung pads for ladders mentioned heretofore and many novel features that result in a new ladder padding device which is not anticipated, rendered obvious, suggested, or even implied by any of the prior art rung pads for ladders, either alone or in any combination thereof.

Still another object of the present invention is to provide a new ladder padding device for cushioning the rungs of ladders for the users thereof.

Still yet another object of the present invention is to provide a new ladder padding device that is easy and convenient to removably fasten to the rungs of ladders.

Even still another object of the present invention is to provide a new ladder padding device that prevents injuries to the users such as bruises when the users are working upon the ladders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
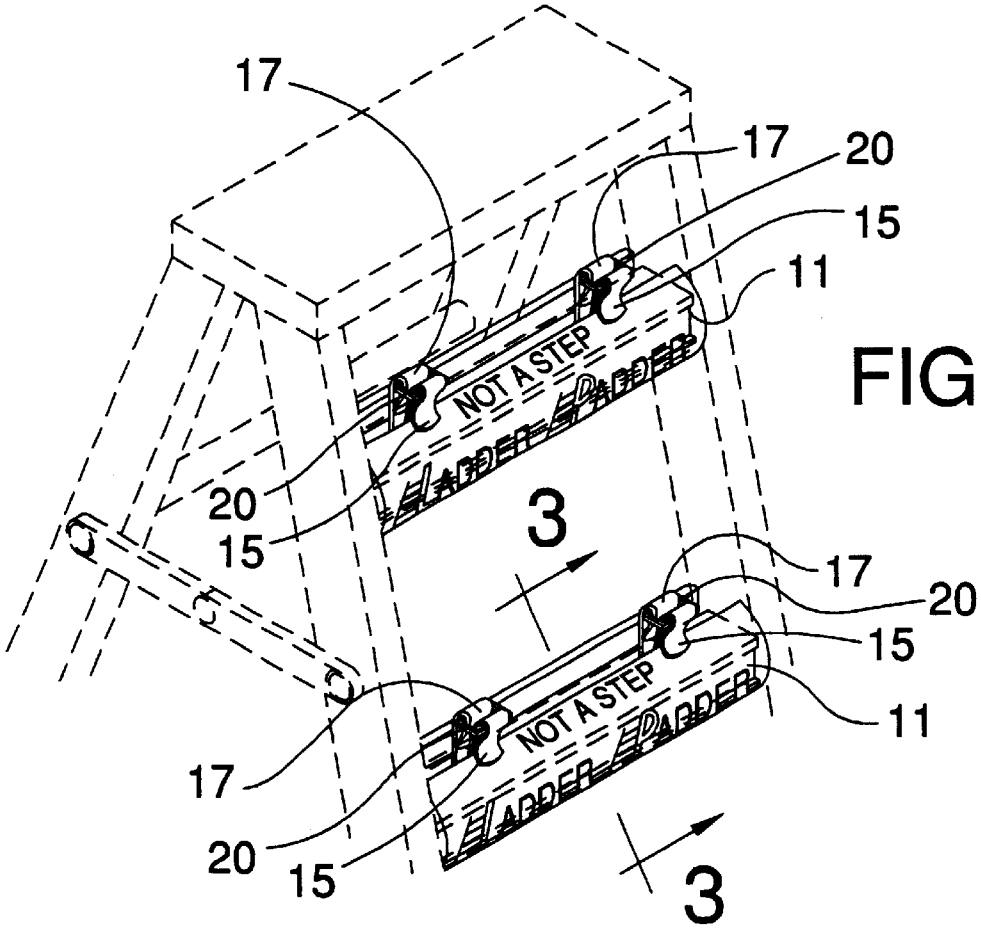
FIG. 1 is a perspective view of a new ladder padding device according to the present invention.
Figure 2:
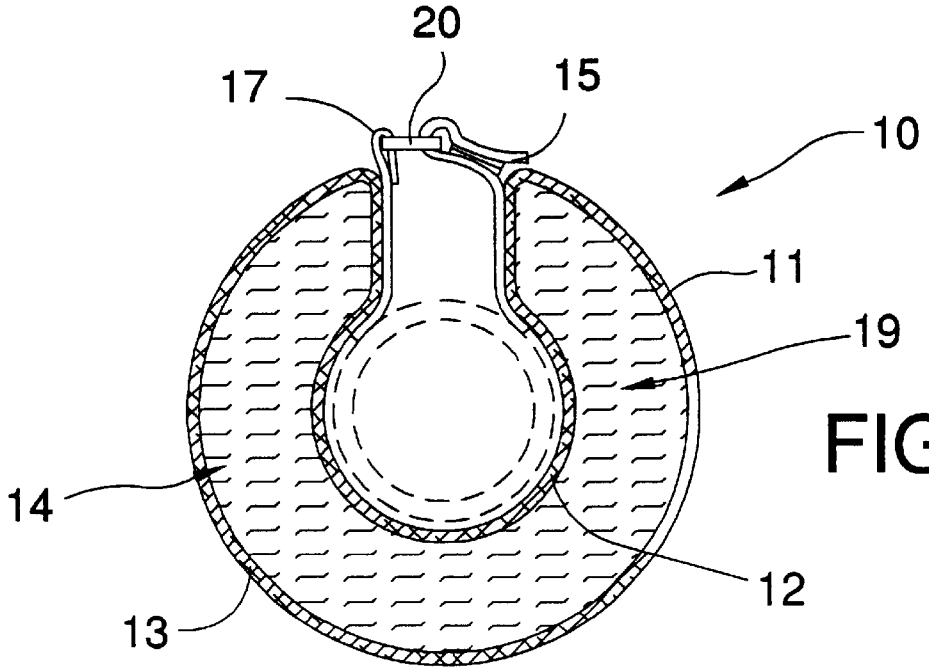
FIG. 2 is a cross-sectional view of the present invention.
Figure 3:
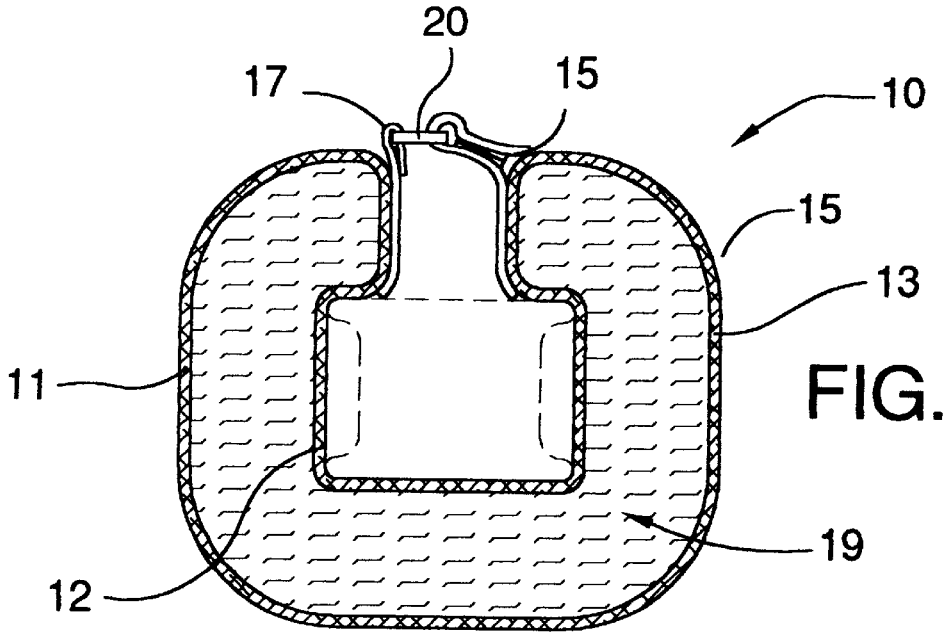
FIG. 3 is a cross-sectional view of a second embodiment of the present invention
Figure 4:
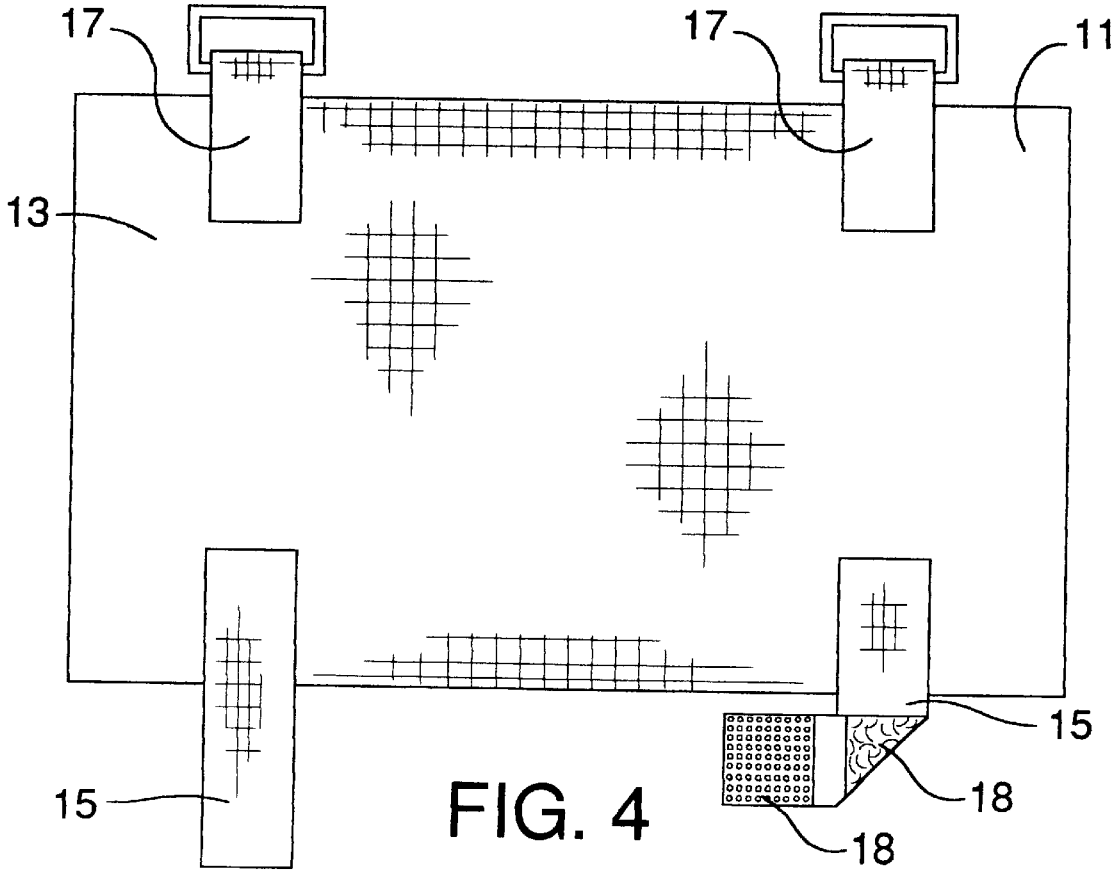
FIG. 4 is a side elevational view of the present invention.

With reference now to the drawings, and in particular to FIGS. 1 through 4 thereof, a new ladder padding device embodying the principles and concepts of the present invention and generally designated by the reference numeral 10 will be described.

As best illustrated in FIGS. 1 through 4, the ladder padding device 10 generally comprises a piece of material 11 being adapted to be fastened about a rung of a ladder. The piece of material 11 has a first layer of material 12 and a second layer of material 13 and also has a cavity 14 disposed between the first and second layers of material 12,13. The piece of material 11 is made of rubberized material and is adapted to extend a length of the rung of the ladder.

Fastening members 15–18 are securely and conventionally attached and sewn to the piece of material 11 for fastening the piece of material 11 to the rung of the ladder. The fastening members 15–18 include straps 15 having first ends 16 which are securely and conventionally attached along an edge of the second layer of material 13, and also having second ends 17; and also include strips of hook and loop fasteners 18 being conventionally attached and sewn to the second ends 17 and the first ends 16 of the straps 15; and further include strap loops 20 being securely and conventionally attached to one of said first and second ends 16,17 of the straps 15. Each of the straps 15 arte fastenable onto itself. The straps 15 are spaced apart along the edge of the second layer of material 13. A padding 19 is disposed in the piece of material 11 for cushioning the rung of the ladder. The padding 19 is disposed in the cavity 14 of the piece of material 11 and is made of a gelatin substance.

In use, the user simply wraps the piece of material 11 about the rung of a ladder and fastens the piece of material 11 with the straps 15 and the strips of hook and loop fasteners 18 which are fastened to one another about the piece of material 11. As the user climbs about the ladder, the ladder padding device 10 provides a cushion when the user bangs one's legs and shins against the rung.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the ladder padding device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder padding device comprising:

a piece of material being adapted to be fastened about a rung of a ladder, said piece of material having a first layer of material and a second layer of material and also having a cavity disposed between said first and second layers of material;

fastening members being attached to said piece of material for fastening said piece of material to the rung of the ladder, said fastening members including straps having first ends which are securely attached along an edge of said second layer of material, and also having second ends; and also including strips of hook and loop fasteners being attached to said second ends and said first ends of said straps, and further including strap loops being attached to one of said first and second ends of said straps, each of said straps being fastenable onto itself, said straps being spaced apart along said edge of said second layer of material; and a padding being disposed in said piece of material for cushioning the rung of the ladder.

2. The ladder padding device as described in claim 1, wherein said padding is disposed in said cavity of said piece of material.

3. The ladder padding device as described in claim 2, wherein said padding is made of a gelatin substance.

4. The ladder padding device as described in claim 3, wherein said piece of material is made of rubberized material and is adapted to extend a length of the rung of the ladder.

* * * * *